US012139301B2

(12) United States Patent
Andberg et al.

(10) Patent No.: US 12,139,301 B2
(45) Date of Patent: Nov. 12, 2024

(54) SEGMENTED SHORTWISE CONTAINER VOLUME APPARATUS

(71) Applicants: Jaclyn Nicole Andberg, Carpinteria, CA (US); Dorian Jay Simon, Carpinteria, CA (US)

(72) Inventors: Jaclyn Nicole Andberg, Carpinteria, CA (US); Dorian Jay Simon, Carpinteria, CA (US)

( * ) Notice: Subject to any disclaimer, the term of this patent is extended or adjusted under 35 U.S.C. 154(b) by 0 days.

(21) Appl. No.: 18/108,647

(22) Filed: Feb. 12, 2023

(65) Prior Publication Data

US 2023/0257161 A1 Aug. 17, 2023

Related U.S. Application Data

(60) Provisional application No. 63/309,536, filed on Feb. 12, 2022.

(51) Int. Cl.
*B65D 21/02* (2006.01)
*B65D 41/02* (2006.01)
*B65D 51/18* (2006.01)

(52) U.S. Cl.
CPC ..... *B65D 21/0224* (2013.01); *B65D 41/02* (2013.01); *B65D 51/18* (2013.01); *B65D 2251/0015* (2013.01); *B65D 2251/0028* (2013.01); *B65D 2251/0078* (2013.01); *B65D 2251/009* (2013.01)

(58) Field of Classification Search
CPC .... B65D 21/0224; B65D 41/02; B65D 51/18; B65D 2251/0015; B65D 2251/0028; B65D 2251/0078; B65D 2251/009
See application file for complete search history.

(56) References Cited

U.S. PATENT DOCUMENTS 2,576,725 A * 11/1951 Schoelies ..... B65D 21/0224 206/509
3,308,980 A * 3/1967 Taylor ..... B65D 77/0486 220/62.22
4,756,424 A * 7/1988 Schwartz ..... A47J 31/02 206/217
D817,633 S * 5/2018 Dutton ..... D3/203.3
11,046,474 B2 * 6/2021 Spallek ..... B65D 17/12
(Continued)

FOREIGN PATENT DOCUMENTS

FR 2680761 A1 * 3/1993 ..... A45D 40/00
WO WO-2019232499 A1 * 12/2019 ..... A23L 2/52

*Primary Examiner* — J. Gregory Pickett
*Assistant Examiner* — Abigail Elizabeth Guidry
(74) *Attorney, Agent, or Firm* — Roger A. Jackson

(57) ABSTRACT

A segmented shortwise container volume apparatus that includes a primary base, a primary surrounding sidewall with an interior, a primary cap with an aperture and a sealing plug, a secondary base, a secondary surrounding sidewall with an interior, a secondary cap with an aperture and a sealing plug, and a sleeve element having a first end portion and an opposing second end portion, the sleeve element having a sleeve outer surface and an opposing sleeve inner surface, wherein the sleeve inner surface is slid over the primary and secondary surrounding sidewalls to hold the primary and secondary bases adjacent to one another, creating a single container with two separate interiors, being the primary and secondary interiors.

3 Claims, 7 Drawing Sheets

(56) References Cited

U.S. PATENT DOCUMENTS

| | | | | |
|---|---|---|---|---|
| 2002/0130126 | A1* | 9/2002 | Rosenberg | B65D 21/083 220/4.26 |
| 2005/0230586 | A1* | 10/2005 | Gary | B65D 81/3886 248/311.2 |
| 2011/0297706 | A1* | 12/2011 | Zoss | B65D 39/007 29/428 |
| 2015/0344185 | A1* | 12/2015 | Corbeil | B65D 21/0237 220/4.21 |
| 2016/0039582 | A1* | 2/2016 | Hui | A45D 34/00 206/459.5 |
| 2016/0167845 | A1* | 6/2016 | Harvey | B65D 50/041 220/23.91 |
| 2018/0029752 | A1* | 2/2018 | Clark | B65D 47/32 |
| 2019/0100355 | A1* | 4/2019 | Merritt | B65D 77/245 |
| 2021/0024273 | A1* | 1/2021 | Andberg | B65D 21/0228 |
| 2023/0257161 | A1* | 8/2023 | Andberg | B65D 25/04 220/4.21 |

* cited by examiner

SEGMENTED SHORTWISE CONTAINER VOLUME APPARATUS

RELATED PATENT APPLICATION

This application claims the benefit of U.S. provisional patent application Ser. No. 63/309,536 filed on Feb. 12, 2022 by Jaclyn Nicole Andberg of Carpinteria, California, U.S. and Dorian Jay Simon of Carpinteria, California, U.S.

TECHNICAL FIELD

The present invention is directed to an apparatus that enhances a user's ability to carry with them and separately consume multiple fluids of any temperature in a single, compact, and portable package that insulates, seals, and separates the multiple fluids from one another.

BACKGROUND OF INVENTION

Similar apparatus are known in the art being manufactured by Hydroflask, Yeti, H2Joe, Golchi, and the like, in the field of portable and compact beverage containers, with some having multiple separate volume beverage containers being used for hiking, camping, fishing, travel, and so on.

In U.S. Pat. No. 8,091,730 to Keefe et al., disclosed is a spill resistant drinking vessel with lid and special valve to help prevent spilling of the beverage inside when the vessel is tipped over, via using a check type valve to restrict flow in a tip over of the vessel, however, to allow the valve to flow when the cover spout was sucked on by the user, see FIGS. 3A and 3B.

In U.S. Pat. No. 8,870,010 to Buck disclosed is a cup lid with integrated container having optionally multiple volumes that are stackable and nested to one another, see FIGS. 12A, 12B, 12C, 12D, 12E, 13, and 15 for typical examples, however, no insulating, or specific fluid sealing is taught.

In U.S. Pat. No. 10,421,595 to Wondka disclosed is a multi-compartment cup for holding a wet compartment for a beverage and a dry compartment for a snack, also to have structure to separately dispense from each compartment, i.e. having wet and dry compartments for specific applications, see FIGS. 1 and 7 in particular, and also see FIGS. 26, 31, and 32.

In United States patent application publication number 2017/0349354 to Garg (assigned to Golchi) disclosed is a multiple housing vacuum insulated canister to store multiple liquids at once. The canister includes a first housing, a second housing, a third housing, a first turning lid, and a second turning lid. The first housing stores a first liquid using the first lid, with the second housing storing solid items, with the first and second housings in a vertically (stacked) attached arrangement. Further a third housing can be employed using the second lid that stores a second liquid attaching vertically to the second housing.

In United States patent application publication 2010/0200438 to Davies discloses a modular container system resulting in a set of interconnected container spaces that are vertically stacked and screwed together in a form close to a water bottle in size, see FIGS. 1 and 2, wherein no specific items were slated to be stored in the container as it was a general use container without openings in the end lids, although the interior compartments could be separate or interconnected.

What is needed is an apparatus that allows the user to carry with them and separately consume multiple fluids in separate volumes of any temperature in a single, compact, and portable package that insulates, seals, and separates the multiple fluids from one another. An additional desirable feature would be to facilitate selectable inter communication as between the multiple volumes to allow a larger volume of fewer different fluids to be carried and consumed by the user.

SUMMARY OF INVENTION

Broadly, the present invention is the segmented shortwise container volume apparatus that includes a primary base, a primary surrounding sidewall extending from the primary base, the primary surrounding sidewall being about a primary lengthwise axis, the primary surrounding sidewall having a primary first end portion and an opposing primary second end portion with the primary lengthwise axis spanning therebetween. The primary surrounding sidewall also including a primary outer surface and an opposing primary inner surface, wherein the primary second end portion is adjacent to the primary base, the primary base and the primary inner surface defining a primary surrounding sidewall interior, the primary surrounding sidewall terminating at the primary first end portion in a primary first margin.

The segmented shortwise container volume apparatus further includes a primary cap having a primary cap outer periphery that has a primary step to be removably engageable to a primary first margin, further the primary cap having a primary cap aperture, a primary plug that is removably engageable to the primary cap aperture, and a secondary base.

The segmented shortwise container volume apparatus also includes a secondary surrounding sidewall extending from the secondary base, the secondary surrounding sidewall being about a secondary longwise axis, the secondary surrounding sidewall having a secondary first end portion and an opposing secondary second end portion with the secondary longwise axis spanning therebetween, the secondary surrounding sidewall also including a secondary outer surface and an opposing secondary inner surface. Wherein the secondary second end portion is adjacent to the secondary base, the secondary base and the secondary inner surface defining a secondary surrounding sidewall interior, the secondary surrounding sidewall terminating at the secondary first end portion in a secondary first margin.

The segmented shortwise container volume apparatus in addition includes a secondary cap having a secondary cap outer periphery that has a secondary step to be removably engagable to the secondary first margin, further the secondary cap having a secondary cap aperture, a secondary plug that is removably engageable to the secondary cap aperture, and a sleeve element having a first end portion and an opposing second end portion with a sleeve axial axis spanning therebetween. The sleeve element having a sleeve outer surface and an opposing sleeve inner surface, wherein the sleeve inner surface is slid over the primary outer surface and the secondary outer surface to hold the primary and secondary base adjacent to one another, wherein the sleeve axial axis, the secondary longwise axis, and the primary lengthwise axis are all positioned co-incident to one another.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
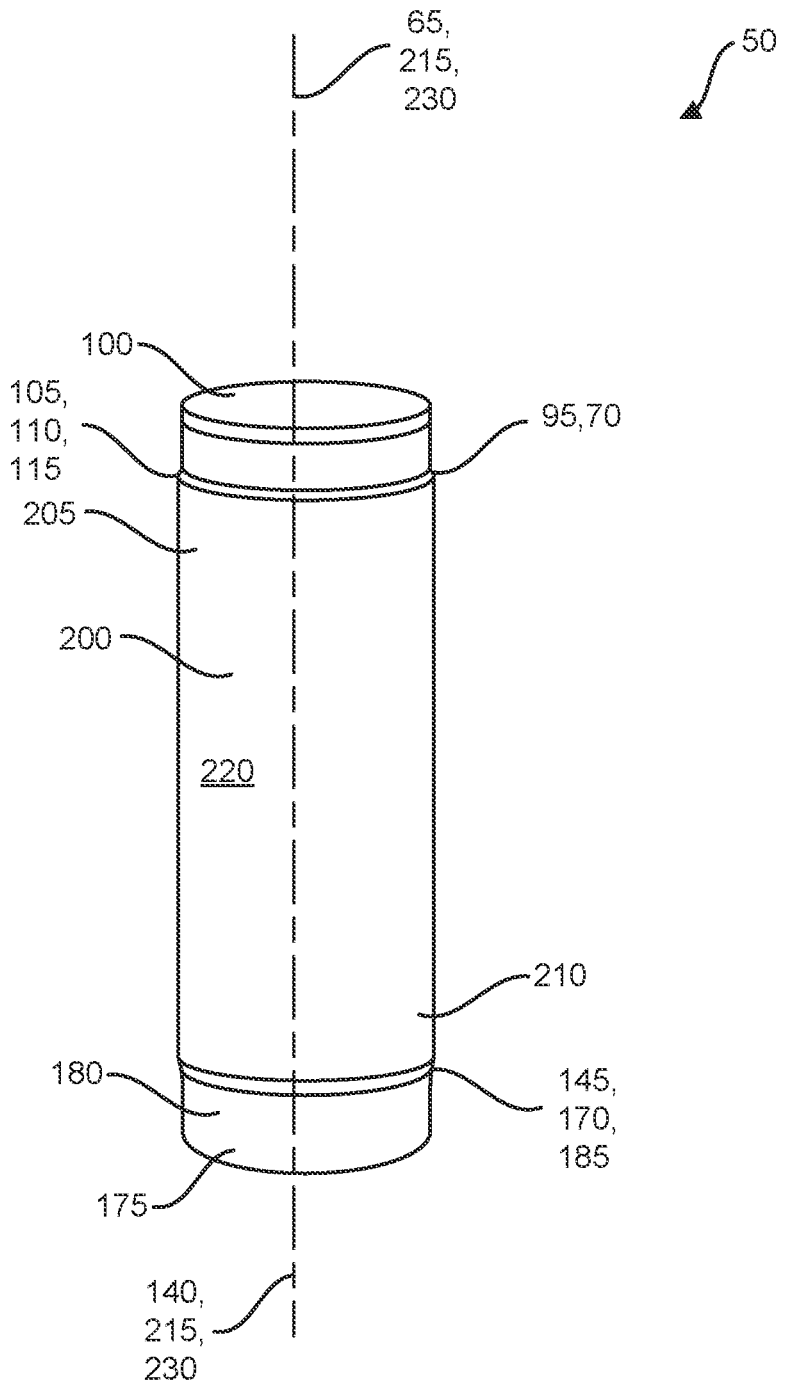
FIG. 1 shows an upper perspective of the segmented shortwise container volume apparatus that includes the sleeve element, the primary and secondary caps, all being about the primary lengthwise axis and the secondary longwise axis.

50 Segmented shortwise container volume apparatus
55 Primary base
60 Primary surrounding sidewall
65 Primary lengthwise axis
70 Primary first end portion
75 Primary second end portion
80 Primary outer surface
85 Primary inner surface
90 Primary surrounding sidewall interior
95 Primary first margin
100 Primary cap
105 Primary cap outer periphery
110 Primary step
115 Removably engageable relationship between the primary step 110 and the primary first margin 95 to one another
120 Primary cap aperture
125 Primary engageable plug
130 Secondary base
135 Secondary surrounding sidewall
140 Secondary longwise axis
145 Secondary first end portion
150 Secondary second end portion
155 Secondary outer surface
160 Secondary inner surface
165 Secondary surrounding sidewall interior
170 Secondary first margin
175 Secondary cap
180 Secondary cap outer periphery
185 Secondary step and secondary first margin being removably engageable to one another
190 Secondary cap aperture
195 Secondary engageable plug
200 Sleeve element
205 Sleeve first end portion
210 Sleeve second end portion
215 Sleeve axial axis
220 Sleeve outer surface
225 Sleeve inner surface
230 Co-incident position of the sleeve axial axis 215, the secondary longwise axis 140, and the primary lengthwise axis 65
235 Alternate segmented shortwise container volume apparatus
240 Alternate primary base
245 Alternate primary surrounding sidewall
250 Alternate primary lengthwise axis
255 Alternate primary first end portion
260 Alternate primary second end portion
265 Alternate primary outer surface
270 Alternate primary inner surface
275 Alternate primary surrounding sidewall interior
280 Alternate primary first margin
285 Alternate secondary base
290 Alternate secondary surrounding sidewall
295 Alternate secondary longwise axis
300 Alternate secondary first end portion
305 Alternate secondary second end portion
310 Alternate secondary outer surface
315 Alternate secondary inner surface
320 Alternate secondary surrounding sidewall interior
325 Alternate secondary first margin
330 Sleeve cap element
335 Sleeve cap element first end portion
340 Sleeve cap element second end portion

345 Sleeve cap element axial axis
350 Sleeve cap element outer surface
355 Sleeve cap element inner surface
360 Slid over position of the sleeve cap element inner surface 355 second end portion 340 to the alternate primary outer surface 265 and a slid over a portion of the alternate secondary outer surface 310
365 Hold position of the alternate primary base 240 adjacent to the alternate secondary first margin 325
370 Cap of the sleeve cap element 330
375 Affixed nature of the cap 370 to the sleeve cap first end portion 335
380 Alternate primary cap aperture
385 Primary fluid communication between the alternate primary cap aperture 380 with the alternate primary surrounding sidewall interior 275
390 Alternate secondary cap aperture
395 Secondary fluid communication between the alternate secondary cap aperture 390 with the alternate secondary surrounding sidewall interior 320 via the fluid communication port 400
400 Fluid communication port disposed within the sleeve cap element 330 between the sleeve cap element outer surface 350 and the sleeve cap element inner surface 355
405 Co-incident position of the sleeve cap axial axis 345, the alternate secondary longwise axis 295, and the alternate primary lengthwise axis 250
410 Alternate primary plug
415 Alternate secondary plug
420 Primary removably engageable structure as between the alternate primary plug 410 and the alternate primary cap aperture 380
425 Secondary removably engageable structure as between the alternate secondary plug 415 and the alternate secondary cap aperture 390

DETAILED DESCRIPTION

Figure 2:
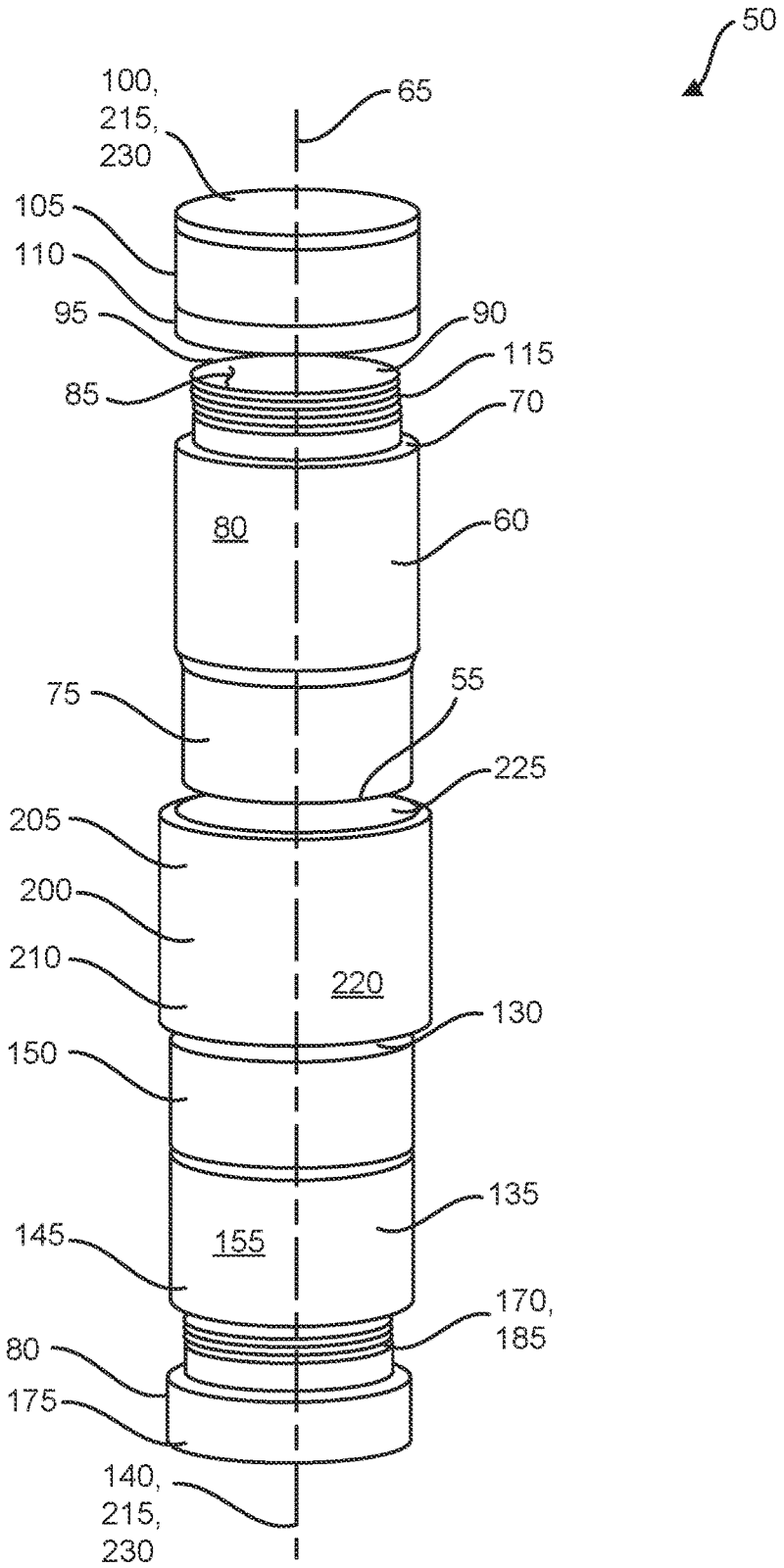
FIG. 2 shows an upper exploded perspective of the segmented shortwise container volume apparatus that includes the sleeve element, the primary and secondary caps, all being about the primary lengthwise axis and the secondary longwise axis, further shown is the primary surrounding sidewall and the secondary surrounding sidewall.

With initial reference to FIG. 1, shown is an upper perspective of the segmented shortwise container volume apparatus 50 that includes the sleeve element 200, the primary 100 and secondary 175 caps, all being about the primary lengthwise axis 65 and secondary longwise axis 140. Continuing, FIG. 2 shows an upper exploded perspective of the segmented shortwise container volume apparatus 50 that includes the sleeve element 200, the primary 100 and secondary 175 caps, all being about the primary lengthwise axis 65 and the secondary longwise axis 140, also showing the primary surrounding sidewall 60 and the secondary surrounding sidewall 135.

Figure 3:
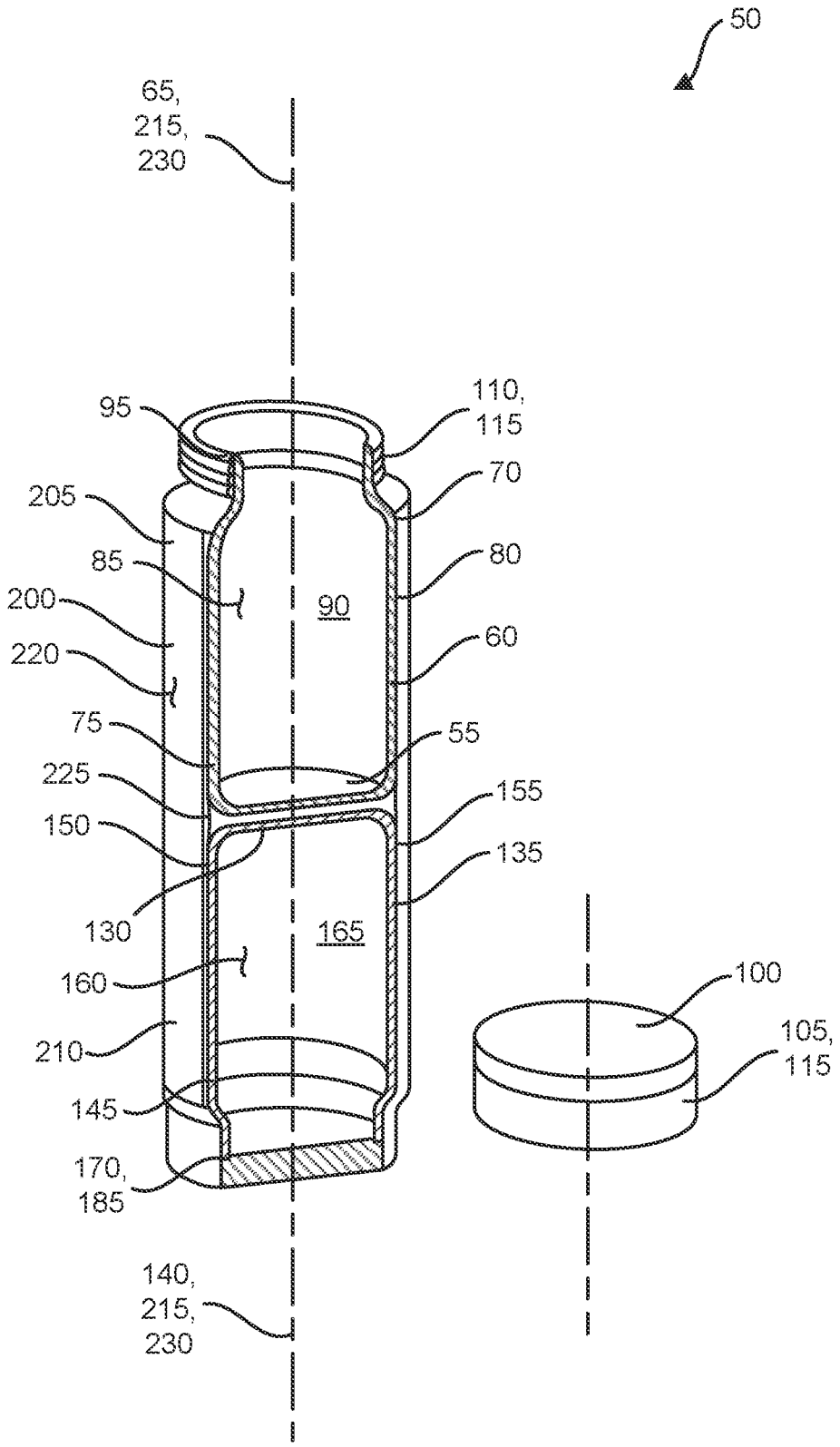
FIG. 3 shows an upper perspective cross sectional view of the segmented shortwise container volume apparatus that includes the sleeve element, the primary surrounding sidewall, the secondary surrounding sidewall, all being about the primary lengthwise axis and the secondary longwise axis, further shown is the primary base and the secondary base all that shows the primary surrounding sidewall interior as distinguished from the secondary surrounding sidewall interior, wherein the primary cap is removed with the secondary cap in place on the secondary surrounding sidewall.

Next, FIG. 3 shows an upper perspective cross sectional view of the segmented shortwise container volume apparatus 50 that includes the sleeve element 200, the primary surrounding sidewall 60, the secondary surrounding sidewall 135, all being about the primary lengthwise axis 65 and the secondary longwise axis 140, further shown is the primary base 55 and the secondary base 130 all that shows the primary surrounding sidewall interior 90 as distinguished from the secondary surrounding sidewall interior 165, wherein the primary cap 100 is removed with the secondary cap 175 in place on the secondary surrounding sidewall 135.

Figure 4:
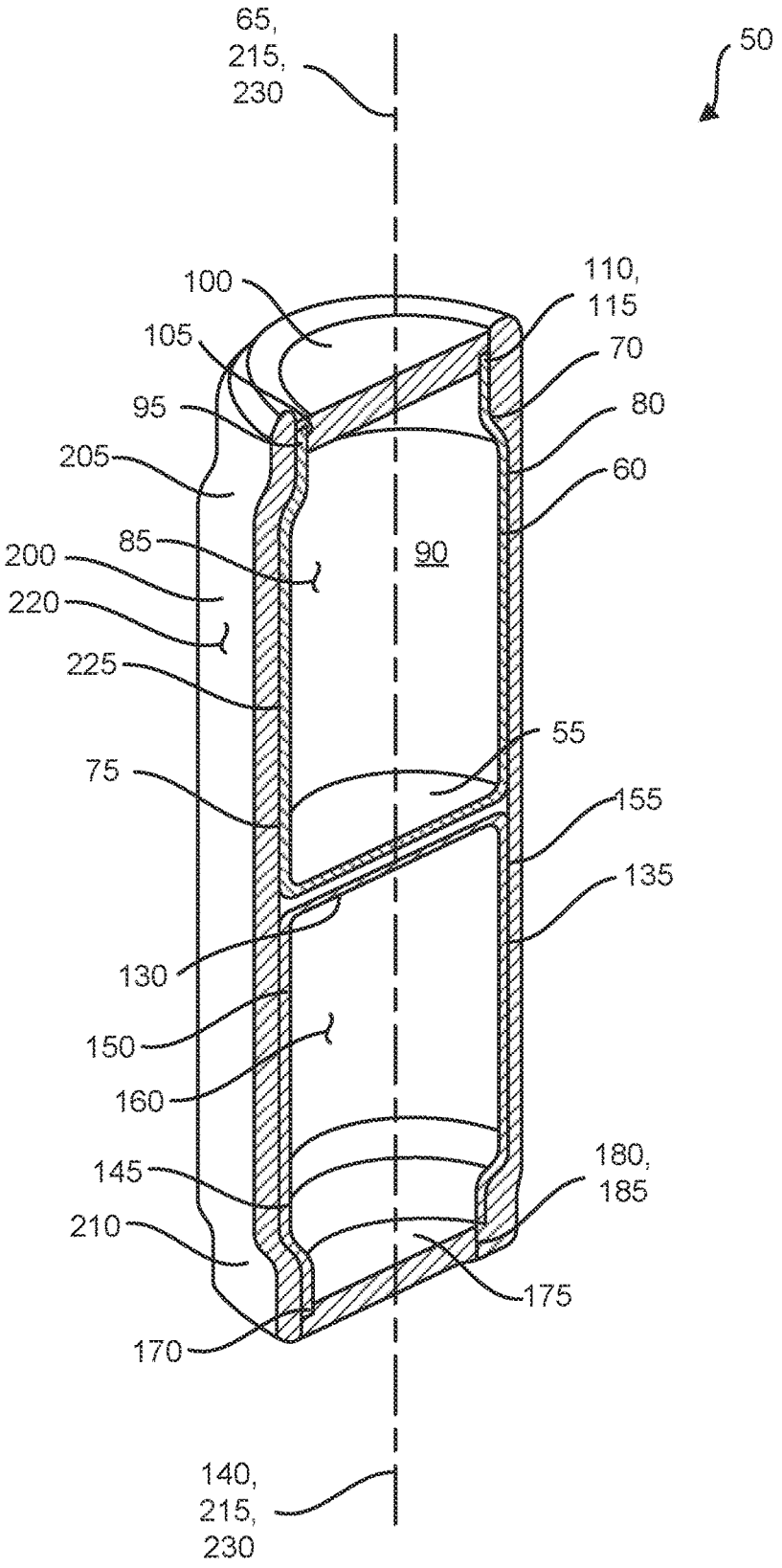
FIG. 4 shows an upper perspective cross sectional view of the segmented shortwise container volume apparatus that includes an alternative extended sleeve element along the primary lengthwise axis and the secondary longwise axis, also shown is the primary surrounding sidewall, the secondary surrounding sidewall, all being about the primary lengthwise axis and secondary longwise axis, also further shown is the primary base and the secondary base all that shows the primary surrounding sidewall interior as distinguished from the secondary surrounding sidewall interior, wherein the primary cap is removed with the secondary cap in place on the secondary surrounding sidewall.

Continuing, FIG. 4 shows an upper perspective cross sectional view of the segmented shortwise container volume apparatus 50 that includes an alternative extended (over the extended primary first end portion 70 and the extended secondary first end portion 145) sleeve element 200 along the primary lengthwise axis 65 and the secondary longwise axis 140, the primary surrounding sidewall 60, the secondary surrounding sidewall 135, all being about the primary lengthwise axis 65 and the secondary longwise axis 140. Further shown in FIG. 4 is the primary base 55 and the secondary base 130 all that shows the primary surrounding sidewall interior 90 as distinguished from the secondary surrounding sidewall interior 165, wherein the primary cap 100 is removed with the secondary cap 175 in place on the secondary surrounding sidewall 135.

Figure 5:
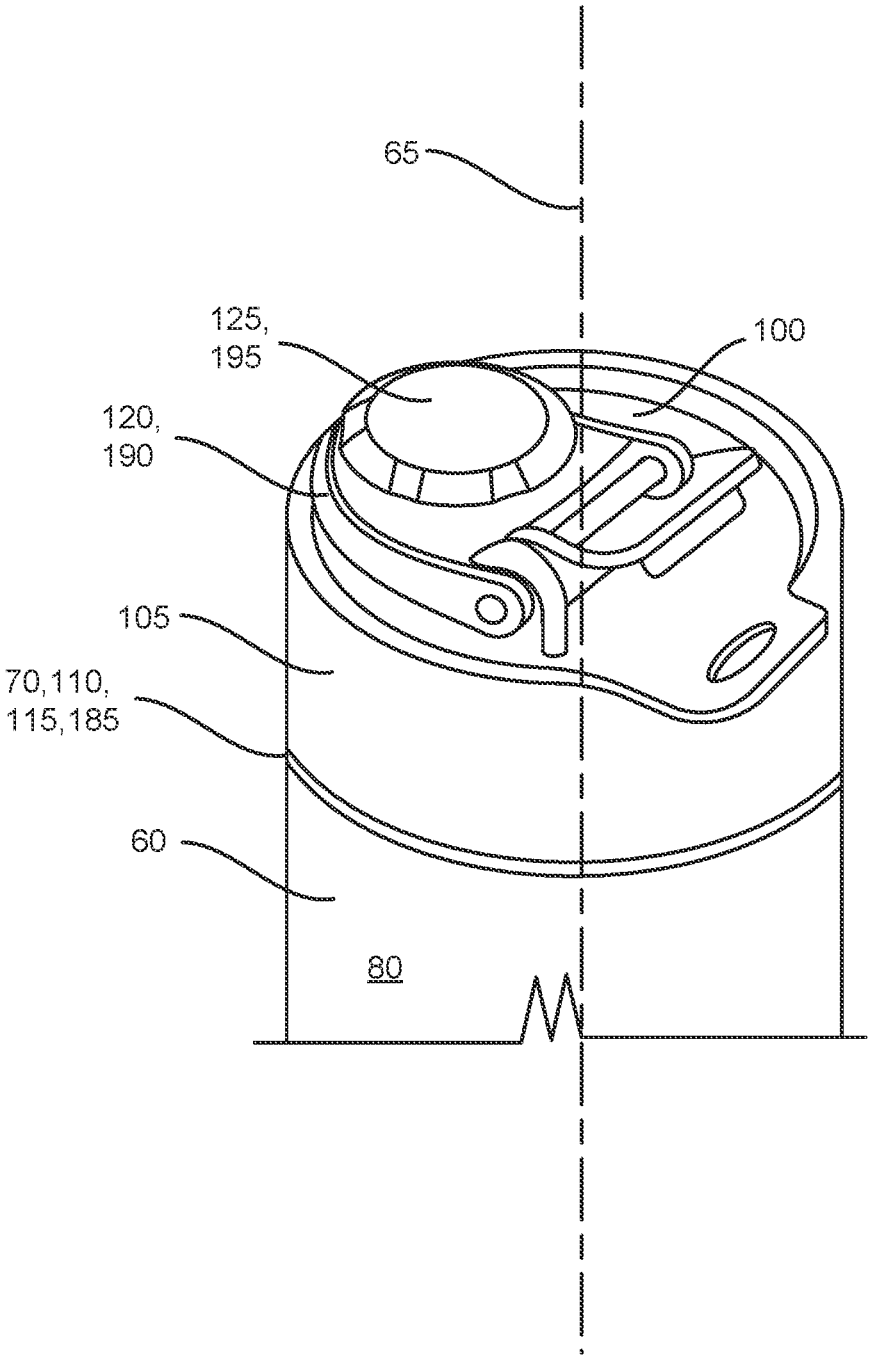
FIG. 5 shows an upper perspective view of the segmented shortwise container volume apparatus that has focus on the primary cap that includes the primary engageable plug that is disposed within a primary cap aperture in a primary closed operational state, wherein, the secondary cap that includes the secondary engageable plug that is disposed within an secondary cap aperture in a secondary closed operational state (not shown)

Next, FIG. 5 shows an upper perspective view of the segmented shortwise container volume apparatus 50 that has focus on the primary cap 100 that includes the primary engageable plug 125 that is disposed within the primary cap aperture 120 in a primary closed operational state, wherein, the secondary cap 175 that includes the secondary engageable plug 195 that is disposed within a secondary cap aperture 190 in a secondary closed operational state (not shown).

Figure 6:
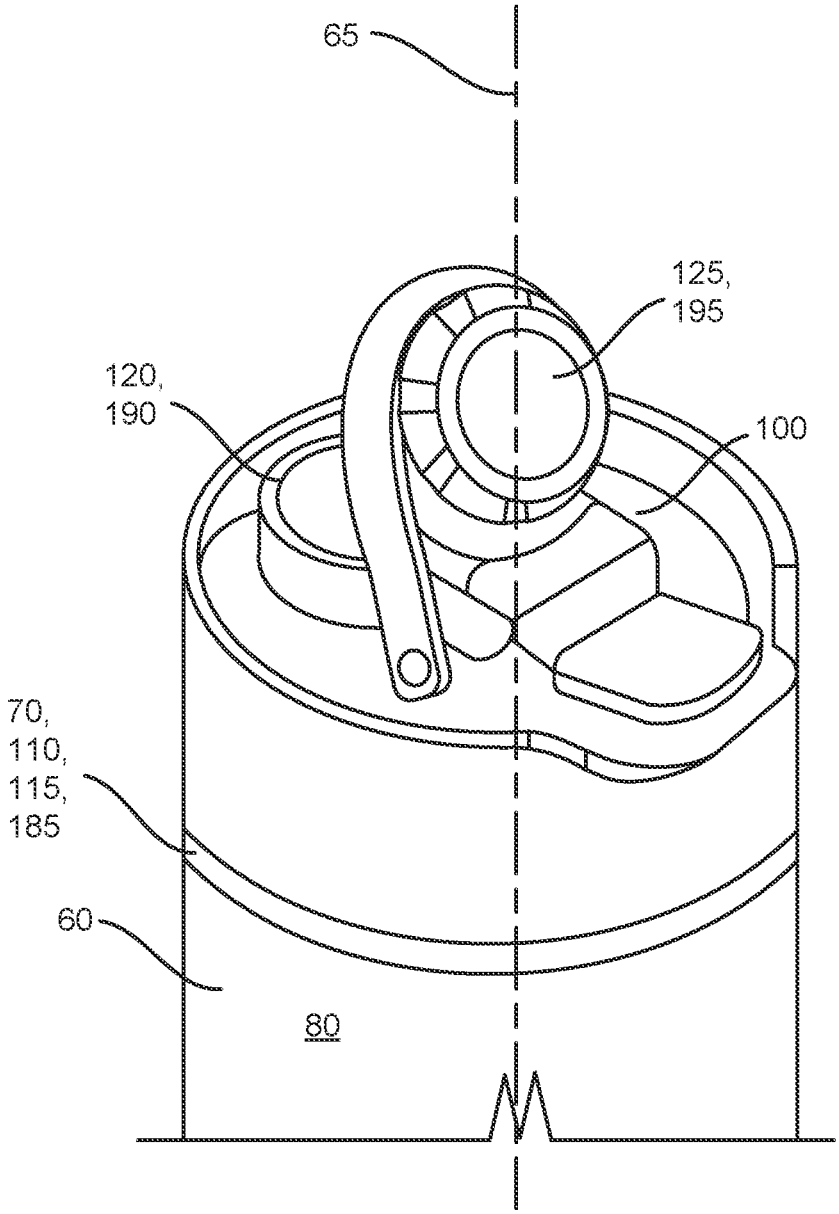
FIG. 6 shows an upper perspective view of the segmented shortwise container volume apparatus that has focus on the primary cap that includes the primary engageable plug that is removed from the primary cap aperture in a primary open operational state, wherein, the secondary cap that includes the secondary engageable plug that is removed from the secondary cap aperture in a secondary open operational state (not shown)

Continuing, FIG. 6 shows an upper perspective view of the segmented shortwise container volume apparatus 50 that has focus on the primary cap 100 that includes the primary engageable plug 125 that is removed from the primary cap aperture 120 in a primary open operational state, wherein, the secondary cap 175 that includes the secondary engageable plug 195 that is removed from the secondary cap aperture 190 in a secondary open operational state (not shown).

Figure 7:
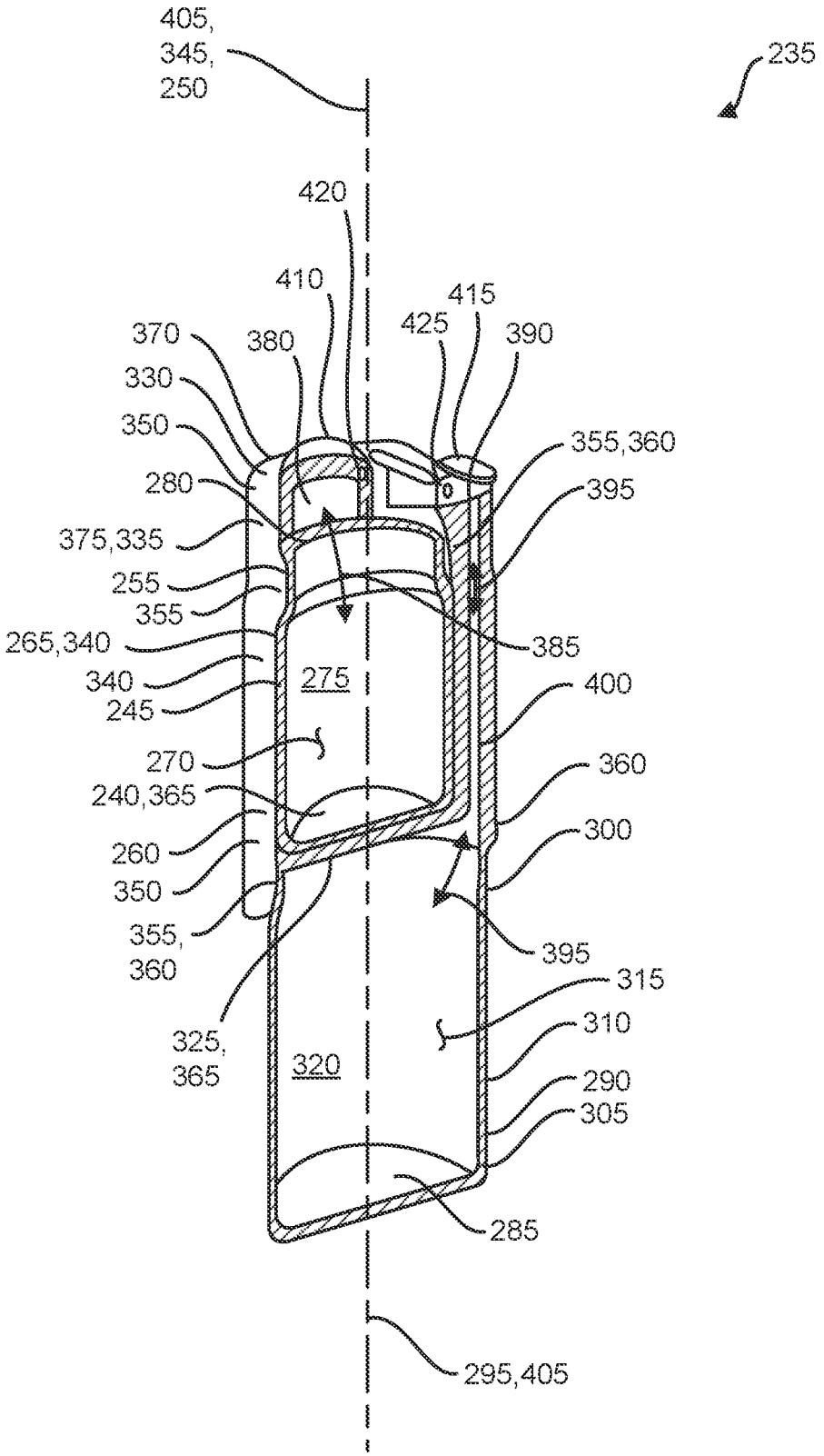
FIG. 7 shows an upper perspective cross sectional view of an alternative embodiment of the segmented shortwise container volume apparatus that includes the sleeve cap element, the alternate primary surrounding sidewall, the alternate secondary surrounding sidewall, all being about the alternate primary lengthwise axis and the alternate secondary longwise axis, further shown is the alternate primary base and the alternate primary surrounding sidewall interior as distinguished from the alternate secondary surrounding sidewall interior, wherein a single sleeve cap element is in communication with both the alternate primary surrounding sidewall interior and the alternate secondary surrounding sidewall interior from a single end of the alternative embodiment of the segmented shortwise container apparatus through the fluid communication port disposed within the sleeve cap element resulting in alternate primary and secondary plugs in the single sleeve cap that are in communication with the alternate primary surrounding sidewall interior and the alternate secondary surrounding sidewall interior respectively.

Further, FIG. 7 shows an upper perspective cross sectional view of an alternative embodiment of the segmented shortwise container volume apparatus 235 that includes the sleeve cap element 330, the alternate primary surrounding sidewall 245, the alternate secondary surrounding sidewall 290, all being about the alternate primary lengthwise axis 250 and alternate secondary longwise axis 295, further shown is the alternate primary base 240 and the alternate primary surrounding sidewall interior 275 as distinguished from the alternate secondary surrounding sidewall interior 320. Wherein a single sleeve cap element 330 is in communication with both the alternate primary surrounding sidewall interior 275 and the alternate secondary surrounding sidewall interior 320 from a single end of the alternative embodiment of the segmented shortwise container apparatus 235 through the fluid communication port 400 that is disposed within the sleeve cap element 330, resulting in the alternate primary 410 and the secondary 415 plugs in the single sleeve cap 330 that are in communication with the alternate primary surrounding sidewall interior 275 and the alternate secondary surrounding sidewall interior 320 respectively.

Broadly, in looking at FIGS. 1 to 6, of the segmented shortwise container volume apparatus 50 that includes the primary base 55, the primary surrounding sidewall 60 extending from the primary base 55, the primary surrounding sidewall 60 being about the primary lengthwise axis 65, the primary surrounding sidewall 60 having the primary first end portion 70 and the opposing primary second end portion 75 with the primary lengthwise axis 65 spanning therebetween. The primary surrounding sidewall 60 also including the primary outer surface 80 and the opposing primary inner surface 85, wherein the primary second end portion 75 is adjacent to the primary base 55, the primary base 55 and the primary inner surface 85 defining a primary surrounding sidewall interior 90, the primary surrounding sidewall 60 terminating at the primary first end portion 70 in a primary first margin 95, see in particular FIGS. 3 and 4.

The segmented shortwise container volume apparatus 50 further includes the primary cap 100 having the primary cap outer periphery 105 that has the primary step 110 to be removably engageable 115 to the primary first margin 95, further the primary cap 100 having the primary cap aperture 120, the primary plug 125 that is removably engageable to the primary cap aperture 120 and the secondary base 130, see in particular FIGS. 5 and 6.

The segmented shortwise container volume apparatus 50 also includes the secondary surrounding sidewall 135 extending from the secondary base 130, the secondary surrounding sidewall 135 being about the secondary longwise axis 140, the secondary surrounding sidewall 135 having the secondary first end portion 145 and the opposing secondary second end portion 150 with the secondary longwise axis 140 spanning therebetween. The secondary surrounding sidewall 135 also including the secondary outer surface 155 and the opposing secondary inner surface 160, wherein the secondary second end portion 150 is adjacent to the secondary base 130, the secondary base 130 and the secondary inner surface 160 defining a secondary surrounding sidewall interior 165, the secondary surrounding sidewall 135 terminating at the secondary first end portion 145 in a secondary first margin 170, see in particular FIGS. 3 and 4.

The segmented shortwise container volume apparatus 50 in addition includes the secondary cap 175 having the secondary cap outer periphery 180 that has the secondary step 185 to be removably engageable 185 to the secondary first margin 170, further the secondary cap 175 having the secondary cap aperture 190, the secondary plug 195 that is removably engageable to the secondary cap aperture 190, and the sleeve element 200 having the first end portion 205 and the opposing second end portion 210 with the sleeve axial axis 215 spanning therebetween. The sleeve element 200 having the sleeve outer surface 220 and the opposing sleeve inner surface 225, wherein the sleeve inner surface 225 is slid over the primary outer surface 80 and the secondary outer surface 155 to hold the primary 55 and secondary 130 bases adjacent to one another, wherein the sleeve axial axis 215, the secondary longwise axis 140, and the primary lengthwise axis 65 are all positioned co-incident 230 to one another, see in particular FIGS. 1 to 4.

Looking at FIG. 7, the alternate segmented shortwise container volume apparatus 235 is disclosed that includes the alternate primary base 240, the alternate primary surrounding sidewall 245 extending from the alternate primary base 240, the alternate primary surrounding sidewall 245 being about the alternate primary lengthwise axis 250, the alternate primary surrounding sidewall 245 having the alternate primary first end portion 255 and the opposing alternate primary second end portion 260 with the alternate primary lengthwise axis 250 spanning therebetween. The alternate primary surrounding sidewall 245 also including the alternate primary outer surface 265 and the opposing alternate primary inner surface 270, wherein the alternate primary second end portion 260 is adjacent to the alternate primary base 240, the alternate primary base 240 and the alternate primary inner surface 270 defining the alternate primary surrounding sidewall interior 275, the alternate primary surrounding sidewall 245 terminating at the alternate primary first end portion 255 in the alternate primary first margin 280.

The alternate segmented shortwise container volume apparatus 235 further includes the alternate secondary base 285 and the alternate secondary surrounding sidewall 290 extending from the alternate secondary base 285, the alternate secondary surrounding sidewall 290 being about the alternate secondary longwise axis 295, the alternate secondary surrounding sidewall 290 having the alternate secondary first end portion 300 and the opposing alternate secondary second end portion 305 with the alternate secondary longwise axis 295 spanning therebetween. The alternate secondary surrounding sidewall 290 also including the alternate secondary outer surface 310 and the opposing alternate secondary inner surface 315, wherein the alternate secondary second end portion 305 is adjacent to the alternate secondary base 285, the alternate secondary base 285 and the alternate secondary inner surface 315 defining an alternate secondary surrounding sidewall interior 320, the alternate secondary surrounding sidewall 290 terminating at the alternate secondary first end portion 300 in the alternate secondary first margin 325.

The alternate segmented shortwise container volume apparatus 235 also includes the sleeve cap element 330 having the first end portion 335 and the opposing second end portion 340 with the sleeve cap 330 axial axis 345 spanning therebetween, the sleeve cap element 330 having a sleeve cap outer surface 350 and the opposing sleeve cap inner surface 355, wherein the sleeve cap inner surface 355 second end portion 340 is slid over 360 the alternate primary outer surface 265 and a portion of the alternate secondary outer surface 310 to hold 365 the alternate primary base 240 adjacent to the alternate secondary first margin 325, further the sleeve cap element 330 includes a cap 370 that is affixed 375 to the sleeve cap first end portion 335, wherein the cap 330 includes the alternate primary aperture 380 therethrough that is in a primary fluid communication 385 with the alternate primary surrounding sidewall interior 275. The cap 330 also has the alternate secondary aperture 390 therethrough that that is in a secondary fluid communication 395 with the alternate secondary surrounding sidewall interior 320 via the fluid communication port 400 that is disposed within the sleeve cap element 330 as between the sleeve cap outer surface 350 and the opposing sleeve cap inner surface 355. Wherein the sleeve cap axial axis 345, the alternate secondary longwise axis 295, and the alternate primary lengthwise axis 250 are all positioned co-incident 405 to one another.

As an option for the segmented shortwise container volume apparatus 235, it can further comprise the alternate primary plug 410 that is primary removably engageable 420 to the alternate primary aperture 380. Another option for the segmented shortwise container volume apparatus 235, it can further comprise an alternate secondary plug 415 that is secondary removably engageable 425 to the alternate secondary aperture 390.

CONCLUSION

Accordingly, the present invention of the segmented shortwise container volume apparatus has been described with some degree of particularity directed to the embodiments of the present invention. It should be appreciated, though; that the present invention is defined by the following claims construed in light of the prior art so modifications and changes may be made to the exemplary embodiments of the present invention without departing from the inventive concepts contained therein.

The invention claimed is:

1. An alternate segmented shortwise container volume apparatus, comprising (a) an alternate primary base;

(b) an alternate primary surrounding sidewall extending from said alternate primary base, said alternate primary surrounding sidewall being about an alternate primary lengthwise axis, said alternate primary surrounding sidewall having an alternate primary first end portion and an opposing alternate primary second end portion with said alternate primary lengthwise axis spanning therebetween, said alternate primary surrounding sidewall also including an alternate primary outer surface and an opposing alternate primary inner surface, wherein said alternate primary second end portion is adjacent to said alternate primary base, said alternate primary base and said alternate primary inner surface defining an alternate primary surrounding sidewall interior, said alternate primary surrounding sidewall terminating at said alternate primary first end portion in an alternate primary first margin;

(c) an alternate secondary base;

(d) an alternate secondary surrounding sidewall extending from said alternate secondary base, said alternate secondary surrounding sidewall being about an alternate secondary longwise axis, said alternate secondary surrounding sidewall having an alternate secondary first end portion and an opposing alternate secondary second end portion with said alternate secondary longwise axis spanning therebetween, said alternate secondary surrounding sidewall also including an alternate secondary outer surface and an opposing alternate secondary inner surface, wherein said alternate secondary second end portion is adjacent to said alternate secondary base, said alternate secondary base and said alternate secondary inner surface defining an alternate secondary surrounding sidewall interior, said alternate secondary surrounding sidewall terminating at said alternate secondary first end portion in an alternate secondary first margin; and (e) a sleeve cap element having a first end portion and an opposing second end portion with a sleeve cap axial axis spanning therebetween, said sleeve cap element having a sleeve cap outer surface and an opposing sleeve cap inner surface, wherein said sleeve cap inner surface second end portion is slid over said alternate primary outer surface and a portion of said alternate secondary outer surface to hold said alternate primary base adjacent to said alternate secondary first margin, further said sleeve cap element includes a cap that is affixed to said sleeve cap first end portion, wherein said cap includes an alternate primary aperture therethrough that is in a primary fluid communication with said alternate primary surrounding sidewall interior and said cap also has an alternate secondary aperture therethrough that that is in a secondary fluid communication with said alternate secondary surrounding sidewall interior via a fluid communication port that is disposed within said sleeve cap element as between said sleeve cap outer surface and an opposing sleeve cap inner surface, resulting in said alternate primary cap aperture and said alternate secondary cap aperture respectively in primary fluid communication and said secondary fluid communication to said alternate primary surrounding sidewall interior and said alternate secondary surrounding sidewall interior, that are positioned in an axially stackable manner along said alternate primary lengthwise axis and said alternate secondary longwise axis, such that said alternate primary base fully face contacts said alternate secondary first margin with said alternate primary lengthwise and said alternate secondary longwise axes both spanning therebetween, wherein said alternate primary base fully face contacts said alternate secondary first margin solely separates said alternate primary surrounding sidewall interior and said alternate secondary surrounding sidewall interior that further results in said port extending beyond said alternate primary first end portion and said port on an opposing end extending beyond said alternate primary base, wherein said sleeve cap axial axis, said alternate secondary longwise axis, and said alternate primary lengthwise axis are all positioned co-incident to one another.

2. A segmented shortwise container volume apparatus according claim 1 further comprising an alternate primary plug that is primary removably engageable to said alternate primary aperture.

3. A segmented shortwise container volume apparatus according claim 1 further comprising an alternate secondary plug that is secondary removably engageable to said alternate secondary aperture.

* * * * *